United States Patent [19]

Berens et al.

[11] 4,124,779

[45] Nov. 7, 1978

[54] DUAL CHANNEL COMMUNICATIONS SYSTEM PARTICULARLY ADAPTED FOR THE AM BROADCAST BAND

[76] Inventors: Stephen Berens, Stone House Rd., Somers, N.Y. 10589; Jack Berens, 217-20 130th Ave., Laurelton, N.Y. 11413

[21] Appl. No.: 832,219

[22] Filed: Sep. 12, 1977

[51] Int. Cl.[2] ..... H04H 5/00

[52] U.S. Cl. ..... 179/15 BT

[58] Field of Search ..... 179/15 BT, 15 BM; 325/36, 60, 61, 139; 343/200

[56] References Cited

U.S. PATENT DOCUMENTS

| | | | |
|---|---|---|---|
| 1,685,357 | 9/1928 | Griggs | 179/15 BT |
| 1,717,064 | 6/1929 | Rettenmeyer | 179/15 BT |
| 2,775,646 | 12/1956 | Grosjean | 179/15 BT |
| 3,714,595 | 1/1973 | Denenberg et al. | 179/15 BT |
| 3,798,376 | 3/1974 | Limberg | 179/15 BT |
| 3,803,490 | 4/1974 | Almering et al. | 179/15 BT |
| 3,944,749 | 3/1976 | Kahn | 179/15 BT |

*Primary Examiner*—Douglas W. Olms
*Attorney, Agent, or Firm*—Arthur L. Plevy

[57] ABSTRACT

A communication system is adapted to particularly operate in the AM (amplitude modulated) broadcast band and accommodates stereo transmission via a left and a right channel. The system includes a transmitter which provides an upper and lower sideband; each containing unique audio information definitive of a right and left channel and generated by means of a common carrier frequency. A receiver is adapted to separate the side bands and to process the same to obtain two independent audio signals indicative of an AM stereo transmission. The system as described is compatible with present day AM receiver broadcasting techniques.

3 Claims, 2 Drawing Figures

TRANSMITTER 10

RECEIVER 23

DUAL CHANNEL COMMUNICATIONS SYSTEM PARTICULARLY ADAPTED FOR THE AM BROADCAST BAND

BACKGROUND OF INVENTION

This invention relates to communications systems in general, and more particularly to an independent single sideband (SBB) transmission and reception apparatus.

The prior art is replete in describing and specifying various types of communications systems employing multiplexing, various modulation schemes or combinations of such techniques to achieve maximum bandwidth efficiency. As is known, various constraints in the bandwidth of a transmitted signal are determined by the particular broadcast band as well as by Governmental Agency regulations. Of particular concern in many communications systems is the transmission of voice at good intelligibility which occurs within a bandwidth of 300Hz to 3,000Hz.

A major industry involved in the transmission of voice and music is the AM or amplitude modulated broadcasting systems and those receivers employed by the public to receive such transmissions. Essentially, the AM broadcast bands covers the range of 550KHz to 1,600KHz, and various stations transmit within the band throughout the world. An AM transmission employs a transmitting bandwidth of about two hundred percent relative to the signal source bandwidth.

In any event, the extreme bandwidth employed is of little consequence as detection of the AM signal is relatively simple and a suitable receiver tuned to the AM band is a relatively reliable and economical apparatus.

The FM (frequency modulated) broadcasting stations have been increasing in activity and the sales of FM receivers are also increasing as compared to AM. The FM broadcast and bandwidth enables "stereo" transmission which provides the listener with an added dimension and hence, is preferred to AM in general.

In order to preserve AM and to provide the listener with stereo broadcast, a system generally designated as "SIMULCAST" was devised. In this system, a portion of the stereo data is transmitted on the AM carrier and the remaining information is transmitted on the FM carrier. In employing this method, a user must possess both an AM and FM receiver, and both the AM and FM transmitters broadcast the desired information simultaneously. Thus, the AM station still depends upon the FM station for implementation of the "SIMULCAST" transmission.

Generally speaking, a desireable apparatus would provide the AM broadcaster with the ability to transmit stereo information within the alloted bandwidth and to do so without substantially increasing the cost and simplicity of the receiving apparatus.

A search regarding the general nature of such systems was conducted in Class 325, sub-classes 45,47 and 141. While many patents were found, they are not deemed to be anticipatory of the techniques to be described herein and are as follows:

| PAT. NO. | DATE | INVENTOR | CLASS |
|---|---|---|---|
| U.S. 3,492,579 | 1/1970 | Carassa | 325/47 |
| U.S. 3,579,111 | 5/1971 | Johannessen et al | 325/141 |
| U.S. 3,603,882 | 9/1971 | Wilson | 325/47 |
| U.S. 3,667,047 | 5/1972 | Iwasaki et al | 325/45 |
| U.S. 3,757,220 | 9/1973 | Abel | 325/47 |
| U.S. 3,824,470 | 7/1974 | Eastmond | 325/45 |
| U.S. 3,909,722 | 9/1975 | Bennett | 325/45 |

-continued

| PAT. NO. | DATE | INVENTOR | CLASS |
|---|---|---|---|
| U.S. 3,939,407 | 2/1976 | Bickford | 325/47 |
| U.S. 3,962,638 | 6/1976 | Sallis | 325/45 |

BRIEF DESCRIPTION OF PREFERRED EMBODIMENT

A communications system particularly adapted for transmitting a first and a second signal, each indicative of separate information content wherein the frequency bandwidth of said information is relatively equal, comprising a first source of signals manifesting first information content within a predetermined band of frequencies, a second source of signals manifesting a second information content within the same band of frequencies, a carrier frequency source for providing at an output a reference frequency different from any component contained in said predetermined band, first modulating means responsive to said first signal and said carrier frequency to provide at an output a first modulated signal having frequency components above said carrier frequency, second modulating means responsive to said second signal and said carrier frequency to provide at an output a second modulated signal having frequency components below said carrier frequency, means for combining said first and second modulated signals to provide a composite signal and means responsive to said composite signal for propagating the same over a transmission path, and receiver means responsive to said signal as propagated, said receiver including processing means for retreiving said first and second signals from said composite signal.

DETAILED DESCRIPTION OF FIGURES

Figure 1:
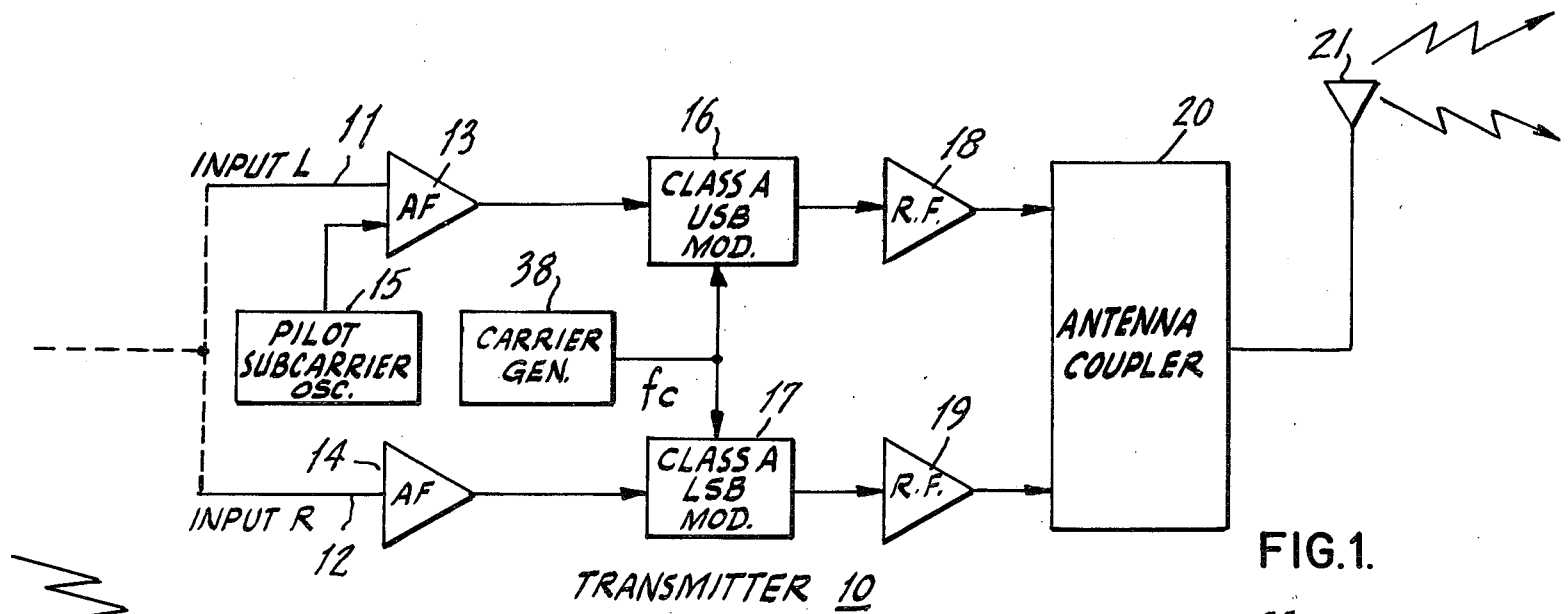
FIG. 1 is a block diagram of a transmitter apparatus according to this invention.

Referring to FIG. 1, there is shown a block diagram of an AM transmitter 10 operating according to the principles of this invention.

Two signals designated as a LEFT (L) and a RIGHT (R) are formulated at the transmitter for transmission of the stereo broadcast. The signals L and R are both within the audio range and may each have a bandwidth extending from 250Hz to 5KHz more or less in order to preserve voice or music fidelity. Techniques of providing such signals indicative of suitable information to be conveyed are known and as such, the "L" channel may contain music, while the "R" channel voice or different instruments and so on; all within the ken of known stereo techniques. Hence, the "L" signal 11 is applied to an input of a typical audio frequency amplifier 13, while the "R" signal 12 is applied to the input of an audio amplifier 14.

By way of example, a "pilot tone" or a pilot subcarrier frequency is generated by a suitable oscillator 15 and is summed or added to the signal emanating from audio amplifier 13. It is noted that this signal from oscillator 15 could be added to amplifier 14 as well.

The output terminals of the audio amplifier 13 and 14 are respectively coupled to an associated Class A modulator 16 and 17. Hence, the output of amplifier 13 is directed to an upper sideband modulator 16 (USB), while the output of amplifier 14 is directed to an input of a lower sideband modulator (LSB) 17. Each modulator receives a carrier frequency signal from a carrier generator oscillator 38. The modulators 16 and 17 are Class A modulators.

Essentially, a Class A modulator as 16 and 17 provides modulation products about the carrier frequency. During the presence of an audio signal, the modulator provides an output proportional to the signal level. A Class A modulator as 16 or 17 as employed in this invention, may be implemented by the use of available integrated circuits or by field effect transistors. In such a modulator, the amplification of an active device as a transistor is made to vary according to modulating voltage. The modulators as 16 and 17 provide both upper and lower sidebands centered about the injected carrier frequency and the desired sideband and residual carrier is filtered by means of a bandpass filter included within the modulator.

Essentially, the USB modulator 16 includes a filter to pass the upper sideband of the modulation process, while the LSB modulator 17 includes a filter to pass only the lower sideband of that modulation process. Generally speaking, the carrier frequency *fc* is much higher than either the R and L signals and separation of the sidebands is accomplished by bandpass filters with bandwidths approximately equal to the bandwidth of the audio signal and centered about the carrier frequency as modulated.

The technique of sideband separation is well known. Basically, the output of modulator 16 contains an upper sideband determined by the carrier frequency *fc* and modulated according to the "L" input signal 11. Similarly, modulator 17 provides a lower sideband signal determined also by the carrier *fc*, and modulated according to the "R" signal 12. Each AM station provides a carrier frequency *fc* to be within the AM band of 550KHz to 1,600KHz. The sidebands thus provided are of necessity within the normal bandwidth employed presently in AM broadcast.

The outputs of the modulators 16 and 17 are applied to the input of a respective radio frequency amplifier, as RF amplifier 18 for modulator 16 and RF amplifier 19 for modulator 17. The RF amplifiers 18 and 19 have outputs applied to an antenna coupler network 20.

The coupler network 20 combines the outputs of amplifiers 18 and 19 and applies the combined signal to the transmitting antenna 21. Such couplers as 20 for combining signals prior to transmission for the purpose of employing a single transmitting antenna 21, are known in the art.

Figure 2:
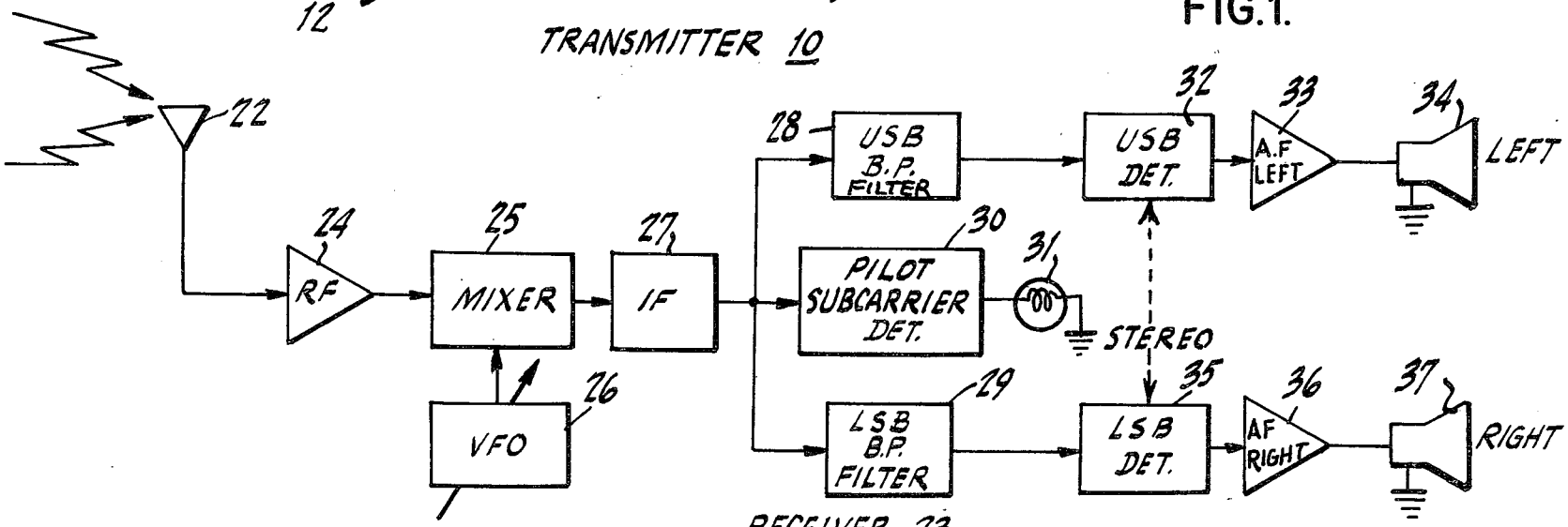
FIG. 2 is a block diagram of a receiver adapted to respond to transmissions according to this invention.

Referring to FIG. 2, there is shown a receiver 23 adapted to respond to the transmitted signal from antenna 21 of transmitter 10 and to process the signal to derive the original "L" and "R" components.

The receiver 23 employs an antenna 22 of conventional construction as a ferrite loop antenna or those presently employed and known in the AM band.

The antenna 22 is coupled to an R.F. amplifier 24 as in a conventional AM receiver. The received signal as amplified by R.F. amplifier 25 is applied to one input of a mixer 25. The other input of mixer 25 is derived from VFO variable frequency or local oscillator 26 employed to tune the receiver to the desired broadcast station. The output of the mixer 25 is applied to the IF amplifier (intermediate frequency) 27, also as in a conventional AM receiver and operating at 455KHz.

The signal from the IF amplifier 27 is then directed to an USB bandpass filter 28, a pilot subcarrier detector 30, and a LSB bandpass filter 29. The bandpass filters 28 and 29 serve to propagate the frequency components associated with the upper and lower sidebands as transmitted and indicative of the Right (R) and Left (L) channels. The output of the bandpass filter 28 is applied to an input of an USB detector 32, while the output of bandpass filter 29 is applied to a lower sideband LSB detector 35.

As indicated, each sideband generated at the transmitter 10 contains a portion of the carrier frequency and hence, the receiver 23 operates as an ordinary receiver in regard to the mixer 25 and IF operation. The bandpass filters 28 and 29 separate the spectrum about the carrier frequency *fc* and the detectors 32 and 35 are then simple amplitude responsive detectors as diode detectors to retrieve the audio information on the carrier. The output of each detector is applied to a separate audio amplifier as AF amplifier 33 to amplify the "L" signal as retrieved and audio amplifier 36 to amplify the "R" signal as retrieved. The amplifiers 33 and 36 are used to drive a right and left speaker 37 and 34 to thence provide a "stereo" signal comprising two distinct sources.

The pilot detector 30 operates to detect the presence of the pilot-tone transmitted along with the "L" signal and upon detection of the same, activates a light or display 31 indicating to the user that the broadcast is a stereo broadcast.

In summation, the system depicted enables AM broadcasting of stereo information within the bandwidth presently accepted by an AM broadcast. Since both modulators at the transmitter operate on the same carrier wave, one maintains full AM bandwidth by assuring that the USB modulator 16 only provides signals above the carrier and all signals below the carrier are removed. The same is true of the LSB modulator 17, which only provides signals below the carrier.

The composite signal is then transmitted conventionally and is so received. In the system, any user who possesses an AM receiver based on current standards, would in fact, receive and be able to hear either the L or R channel depending upon the characteristics of and the tuning of his receiver. Hence, the system is completely compatible with present receivers and will enable one to use a conventional AM receiver but, of course, without the ability to provide the stereo signal. Hence, if the left channel contained only voice and the right channel only music, a present-day receiver might only respond to the voice or the music, or both, depending again on the tuning. This is so as the carrier frequency at the transmitter is sent and hence, the prior art receiver cannot and does not discriminate. In any event, the modified receiver 23 of FIG. 2 does so and will provide stereo reception and performance via speakers 34 and 37.

Hence, the system will enable the AM stations to compete in stereo transmissions and lends itself to greater capability and performance in AM broadcasting.

As shown in FIG. 1, the inputs 11 and 12 can be coupled together if one desired to transmit an ordinary AM broadcast and hence, the same information would be applied to both channels.

We claim:

1. A communications system particularly adapted for transmitting a first and a second signal, each indicative of separate information content wherein the frequency bandwidth of said information is relatively equal, comprising:

(a) a first source of signals manifesting first information content within a predetermined band of frequencies, (b) a second source of signals manifesting second information content, within the same band of frequencies, (c) a carrier frequency source for providing at an output, a reference frequency different from any component contained in said predetermined band, (d) first Class A modulating means responsive to said first signal and said carrier frequency to provide at an output, a first modulated signal having frequency components above said carrier frequency, (e) second Class A modulating means responsive to said second signal and said carrier frequency to provide at an output, a second modulated signal having frequency components below said carrier frequency, (f) means for combining said first and second modulated signals to provide a composite signal and means responsive to said composite signal for propagating the same over a transmission path, (g) means coupled to said first source of signals for adding a pilot subcarrier signal thereto indicative of the transmission of said first and second sources of signals, (h) receiver means responsive to said signal as propagated, said receiver including processing means for retreiving said first and second signals from said composite signal, said receiver means further including detector means responsive to only said composite signal for retreiving said pilot subcarrier signal and means coupled to said detector means for providing an indication of the presence of said pilot signal.

2. The communications system according to claim 1 wherein said first and second signals contain information within the frequency band between 100Hz to 5KHz to 5KHz and said carrier frequency is between 500KHz to 1,600KHz, whereby said system transmits said composite signal within the AM broadcasting band.

3. The communications system according to claim 1 wherein said first and second signals contain information manifesting a stereo performance with one of said signals indicative of a LEFT channel and the other of a RIGHT channel.

* * * * *